United States Patent [19]

Moser

[11] Patent Number: 4,770,116

[45] Date of Patent: Sep. 13, 1988

[54] CONTACT FUSER APPARATUS WITH RELEASE AGENT MANAGEMENT SYSTEM

[75] Inventor: Rabin Moser, Fairport, N.Y.

[73] Assignee: Xerox Corporation, Stamford, Conn.

[21] Appl. No.: 52,325

[22] Filed: May 21, 1987

[51] Int. Cl.[4] ..... G03G 15/20

[52] U.S. Cl. ..... 118/60; 118/70; 118/104; 432/60; 432/228

[58] Field of Search ..... 430/99; 118/60, 70, 118/104; 432/60, 228

[56] References Cited

U.S. PATENT DOCUMENTS

| | | | |
|---|---|---|---|
| 3,716,221 | 2/1973 | Gorka et al. | 118/60 |
| 3,964,431 | 6/1976 | Namiki | 118/60 |
| 4,087,676 | 5/1978 | Fukase | 432/60 X |
| 4,170,957 | 10/1979 | Eddy et al. | 118/60 |
| 4,214,549 | 7/1980 | Moser | 118/60 |
| 4,254,732 | 3/1981 | Moser | 118/60 |

*Primary Examiner*—Evan K. Lawrence

[57] ABSTRACT

A heat and pressure roll fusing apparatus for fixing toner images to copy substrates, the toner comprising a thermoplastic resin. The apparatus includes an internally heated fuser roll cooperating with an unheated bare metal backup or pressure roll to form a nip through which the copy substrates pass with the images contacting the heated roll. The heated fuser roll is characterized by a comformable outer layer or surface which by way of example is fabricated from a silicone rubber or "Viton" material to which a low viscosity polymeric release fluid is applied. Release fluid is contained in a sump and the pressure roll is partially immersed in the fluid. Thus, the release fluid is applied to the surface of the internally heated fuser roll via the bare metal pressure roll. The roll structures are such as to provide maximum area of contact in the nip, while minimizing the area of contact between the pressure roll and the copy substrates.

5 Claims, 1 Drawing Sheet

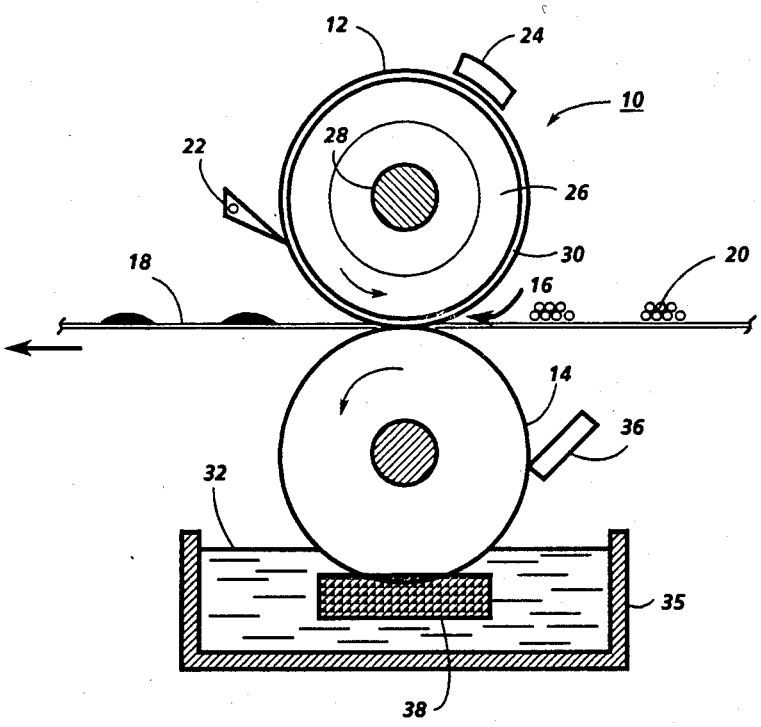
12
24
10
22
28
26
30
20
18
16
14
36
32
35
38

CONTACT FUSER APPARATUS WITH RELEASE AGENT MANAGEMENT SYSTEM

BACKGROUND OF THE INVENTION

This invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the trademark "Teflon" to which a release agent such as silicone oil is applied, the thickness of the "Teflon" being on the order of several mils and the thickness of the oil being less than 1 micron. Silicone based (polydimethylsiloxane) oil which possess a relatively low surface energy, have been found to be materials that are suitable for use in the heated fuser roll environment where "Teflon" constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid "Teflon" outer surface or covering of the aforementioned arrangement.

In attempts to improve at least the perceived quality of the image fused or fixed by a heated roll fuser, such rolls have been provided with conformable surfaces comprising silicone rubber or "Viton" (trademark of E. I. DuPont for a series of fluoroelastomers based on the copolymer of vinylidene fluoride and hexafluoropropylene). As in the case of the "Teflon" coated fuser, oil release fluids such as silicone based oils have been applied to the surface of the silicone rubber or "Viton" to both minimize offsetting and to facilitate stripping. See, for example, U.S. Pat. No. 3,964,431. When the fuser system is one which provides for applying silicone oil to silicone rubber or "Viton" a low viscosity silicone oil (i.e. on the order of 100–1000 cs) has most commonly been employed.

Donor roll RAM (release agent management) systems have been used as part of roll fuser apparatus for some time. Such a RAM system is disclosed in U.S. Pat. No. 4,214,549 issued on July 29, 1980 to Moser. This patent illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

U.S. Pat. No. 3,716,221 issued on Feb. 13, 1973 to Gorka et al discloses a heat and pressure fuser roll wherein the heated fuser roller includes a fusing roller having a resilient fusing blanket supported on the periphery thereof and heating means to heat the fusing blanket to a temperature sufficient to fuse the particulate material on a copy sheet. A backup roller is urged toward engagement with the deformable fusing blanket to press the receptor sheet carrying the particulate material into contact with the fusing roller. The fuser roller is coated with an off-set preventing liquid which is applied thereto from the backup roller at predetermined intervals during operation of the device. The off-set preventing liquid is applied to the backup roller via a wick, one end of which is immersed in a quantity of the liquid which is contained in a receptacle. The application of the liquid to the backup roller is controlled such that it is applied once every eleventh revolution of the fuser roller. In other words ten copy sheets are passed through the fuser and then the fuser and backup rollers are rotated an eleventh time without a copy sheet passing therebetween at which time the liquid is applied to the fuser roller via the wick and backup roller.

Compared to wicks, a donor roll RAM provides a significant oil uniformity microscopically on a copy and also to copy for long runs. One major disadvantage of a donor roll RAM system is it creates a a major thermal load on the fuser during standby as well as during run. The power going into the RAM system at cold start was determined to be 1000 watts and greater than 200 watts during run. Another disadvantage of the donor roll RAM system is the added UMC (unit manufacturing cost) of the system which in the Moser patent comprises a metering roll, a donor roll and a wiper blade. When a wick is used to apply the liquid to the pressure roller, as in the case of the '221 patent, the liquid is applied as drops or droplets rather than in a thin layer.

Not only is it desirable to have a RAM system that uniformly applies the release agent material to the heated fuser roll without draining heat therefrom, it is likewise desirable to reduce the UMC of RAM systems by minimizing the number of components utilized therefor.

BRIEF SUMMARY OF THE INVENTION

In accordance with the present invention as will be described hereinafter in greater detail, the pressure roll of my heat and pressure fuser is used to meter and deliver the off-set preventing liquid or release agent material in the form of silicone oil to the fuser roll. In the presently contemplated embodiment, the pressure roll comprises a hard bare metal roll similar to the metering roll in the aforementioned Moser patent. The pressure roll is immersed in a quantity of release agent contained in a sump and a doctor blade is provided for effecting the application of a thin layer of oil of a predetermined thickness onto the pressure roll. The fuser roll is a conformable roll which cooperates with the hard pressure roll to form a nip forming heat and pressure fuser (i.e. one where the nip indentation is in the softer fuser roll).

In the foregoing apparatus the area of contact between a typical copy substrate and a hard or non-comformable roll such as the pressure roll is very small (i.e. less than 10%). On the other hand, the area of contact between a conformable fuser roll and such a pressure roll is nearly 100%. Accordingly, the fuser oil can be continuously applied to the pressure roll which will result in the desired amount of oil being presented to the fuser roll and a minimum amount of oil being deposited on the backside of the copy substrate.

DESCRIPTION OF THE DRAWINGS

The single FIGURE is a side elevational schematic view of a heat and pressure fuser incorporating the present invention.

DETAILED DESCRIPTION OF THE PREFERRED EMBODIMENT OF THE INVENTION

Referring now to the FIGURE, it can be seen that the invention is directed to a roll fuser apparatus generally indicated 10. The fuser apparatus comprises a heated roll structure 12 cooperating with a nonheated backup or pressure roll structure 14 to form a nip 16 through which a copy substrate 18 passes with toner images 20 formed thereon in a well known manner. The toner images 20 contact the heated roll structure while a force is applied between the roll structure in a well known manner to create pressure therebetween resulting in the deformation of the fuser roll structure by the pressure roll structure to thereby form the nip 16.

As the substrate passes out of the nip, it is stripped from the heated roll structure by a plurality (only one shown) of stripping devices 22 after which it is free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, in the order of 375°–400° F.

The heated roll structure 12 comprises a hollow cylinder 26 having a radiant quartz heater 28 disposed in the hollow thereof. When suitably energized via the aforementioned circuitry, the heating element radiates heat to the cylinder which is then conducted to the outer surface of an outer layer 30 of the structure 12 which layer is preferably fabricated from silicone rubber or "Viton" and is conformable.

The backup or pressure roll structure 14 comprises a bare metal roll, the lower end of which is partially immersed in a quantity of silicone release fluid 32 contained in a sump 35.

A wiper blade 36 which may be mounted in a conventional manner adjacent the pressure roll serves to meter the release agent material on the surface of the pressure roll to a desired thickness. A wick 38 is fully immersed in the release agent and contacts the surface of the pressure roll 14. The purpose of the wick is to provide an air seal which disturbs the air layer formed at the surface of the roll 14 during rotation thereof. If it were not for the function of the wick, the air layer would be coextensive with the surface of the roll immersed in the release agent thereby precluding contact between the pressure roll and the release agent.

The wiper blade 36 is preferably fabricated from "Viton" is $\frac{3}{4} \times \frac{1}{8}$ in cross section and has a length coextensive with the pressure roll. The edge of the blade contacting the metering roll has a radius of 0.001–0.010 inch. The blade functions to meter the release agent picked up by the roll 14 to a predetermined thickness, such thickness being of such a magnitude as to result in a fraction of a microliter to several microliters of release agent consumption per copy.

While the pressure roll has been disclosed as a rigid bare metal roll and the heated roll structure as a conformable, it will be appreciated that any construction that yields the desired results is within the spirit and scope of this invention. In other words, any combination of roll structures that provides minimum contact between the pressure roll and the backside of the the copy substrate and a maximum of contact between it and the heated roll structure. An important aspect of the invention resides in the application of the release agent material as a thin layer on the pressure roll. The thickness of the release agent on the pressure roll is such that the release agent is transferred only to the areas of contact between the pressure roll and the copy substrate or the heated roll structure. Thus, where the area of contact is small, as in the case of the pressure roll and the copy substrate, only very little release agent is transferred. In the case of the heated roll structure where the area of contact is great, the transfer of release agent is maximized.

If the release agent were applied as a relatively thick layer or as drops or droplets, a greater transfer of release agent would occur between the pressure roll and the copy substrate even though the area is not large. This is because the transfer is not solely a function of contact area but also release agent thickness.

What is claimed is:

1. Contact fuser apparatus for fixing toner images to copy substrates, said apparatus comprising:

a fuser roll structure;

means for internally heating said fuser roll structure;

a sump;

a quantity of release agent material in said sump;

a non-heated pressure roll structure supported for pressure contact with said fuser roll to form a nip through which copy substrates pass with toner images carried by said substrates contacting the fuser roll structure;

said sump being disposed relative to said pressure roll structure whereby partial immersion of said pressure roll structure in said release agent material is effected;

said fuser roll structure and said pressure roll structure being constructed to maximize the area of contact therebetween and to minimize the area of contact between said pressure roll and copy substrates whereby a minimum of release agent material is transferred to the side of the substrates contacting said pressure roll structure and a maximum of release agent material is transferred from said pressure roll structure to said fuser roll structure.

2. Apparatus according to claim 1 wherein said fuser roll structure comprises a conformable fuser roll structure and said pressure roll structure comprises a hard roll structure.

3. Apparatus according to claim 2 wherein said release agent material comprises silicone oil.

4. Apparatus according to claim 3 including a blade contacting said pressure roll structure for effecting application of said silicone oil to the desired thickness.

5. Apparatus according to claim 4 including a wick immersed in said silicone oil and contacting said pressure roll.

* * * * *